US006568826B1

(12) United States Patent
Kotovsky

(10) Patent No.: US 6,568,826 B1
(45) Date of Patent: May 27, 2003

(54) LIGHTING APPARATUS AND METHOD

(76) Inventor: Irwin Kotovsky, 3941 California Ave., Pittsburgh, PA (US) 15212

( * ) Notice: Subject to any disclaimer, the term of this patent is extended or adjusted under 35 U.S.C. 154(b) by 0 days.

(21) Appl. No.: 09/416,724

(22) Filed: Oct. 13, 1999

(51) Int. Cl.[7] ..... F21S 8/04
(52) U.S. Cl. ..... 362/147; 362/148; 362/150
(58) Field of Search ..... 362/240, 248, 362/234, 253, 279, 290, 147, 148, 150, 362, 364, 365, 367, 368, 372

(56) References Cited

U.S. PATENT DOCUMENTS

| | | | | | |
|---|---|---|---|---|---|
| 2,998,512 | A | | 8/1961 | Duchene et al. | |
| 4,433,367 | A | * | 2/1984 | Shelby | 362/370 |
| 4,459,648 | A | * | 7/1984 | Ullman | 362/307 |
| 4,475,147 | A | | 10/1984 | Kristofek | |
| 4,551,791 | A | | 11/1985 | Salansky | |
| 4,566,057 | A | * | 1/1986 | Druffel | 362/364 |
| 4,745,533 | A | * | 5/1988 | Smerz | 362/364 |
| 4,887,196 | A | * | 12/1989 | Brown | 362/148 |
| 5,034,866 | A | * | 7/1991 | Pujlo | 362/240 |
| 5,211,473 | A | * | 5/1993 | Gordin | 362/297 |
| 5,321,417 | A | * | 6/1994 | Voelzke | 342/32 |
| 5,457,617 | A | * | 10/1995 | Chan | 362/366 |
| 5,473,523 | A | * | 12/1995 | Von Fange | 362/232 |
| 5,581,448 | A | * | 12/1996 | Harwood | 362/147 |
| 5,738,436 | A | * | 4/1998 | Cimmings | 362/294 |
| 5,816,002 | A | * | 10/1998 | Bifano | 52/255 |
| 5,921,655 | A | * | 7/1999 | Nassim | 362/147 |
| 5,951,151 | A | * | 9/1999 | Doubeck | 362/365 |

FOREIGN PATENT DOCUMENTS

EP 0945675 A2 9/1999

* cited by examiner

*Primary Examiner*—Sandra O'Shea
*Assistant Examiner*—Hargobind S. Sawhney
(74) *Attorney, Agent, or Firm*—Ansel M. Schwartz

(57) ABSTRACT

An apparatus for lighting which fits into a wall, ceiling or floor. The apparatus includes a housing having a bottom edge and at least one mechanism for holding a light. The housing having a depth. The apparatus includes a frame having an opening having a width larger than the depth, through which the housing can fit. The housing fits about the frame wherein the bottom edge is hidden by the frame. A method for lighting. The method includes the steps of placing a frame having an opening into a space in a ceiling of a room. Then there is the step of introducing a housing through the opening in the frame into the ceiling. Next there is the step of fitting a bottom edge of the housing about a ridge of the frame which extends inwards into the ceiling wherein the bottom edge is hidden by the frame. Then there is the step of setting at least one mechanism for holding a light in the housing.

62 Claims, 11 Drawing Sheets

MOUNTING FRAME
22
64

1'-5"(432mm)
62
0"-7/8(1022mm)
WIRE ACCESS
(ON ONE SIDE)
45°
46
18

10
8"-15/16
(176mm)
6"-1/8
(156mm)
3"-9/16
(91mm)
1'-6"-1/16 (459mm)
1'-5"-1/4 (438mm)
1'-4"-7/8 (429mm)
44
18
20
54
24
22

50

56

58

60

LIGHTING APPARATUS AND METHOD

FIELD OF THE INVENTION

The present invention is related to an apparatus and method for lighting. More specifically, the present invention is related to an apparatus for lighting where the bottom edge of a housing is hidden by a frame.

BACKGROUND OF THE INVENTION

Light has always provided the ability for people to see the world around them. As such, it is a necessity for people to see indoors. But lighting in and of itself has also taken on an aesthetic element, where the lighting is designed to be part of the structure it illuminates in a way that is unobtrusive and unnoticeable, or conforms as much as possible to its surroundings.

In many fine stores, lighting is very carefully considered for illuminating the products that the store sells. Especially in such settings, the lighting apparatus is desired to be as unnoticeable as possible while serving its purpose of illuminating the products being sold. Recessed lighting is commonly used to accomplish this purpose. In certain types of recessed lighting, the housing is inserted into a wall, ceiling or floor, where the housing holds the light itself. In this type of recessed lighting, the housing is outfitted with a frame which is used to hold lighting in the wall, ceiling or floor. Heretofore, the housing has fitted inside the frame, creating additional edges and thus lines that disrupt the aesthetically pleasing look of a smooth floor, ceiling or wall. The present invention removes these lines to provide a more smooth and continuous look to the wall, ceiling or floor in which the lighting apparatus is disposed.

SUMMARY OF THE INVENTION

The present invention pertains to an apparatus for lighting which fits into a wall, ceiling or floor. The apparatus comprises a housing having a bottom edge and at least one mechanism for holding a light. The housing has a depth. The apparatus comprises a frame having an opening having a width larger than the depth through which the housing can fit. The housing fits about the frame wherein the bottom edge is hidden by the frame.

The present invention pertains to a method for installing an apparatus for lighting. The method comprises the steps of placing a frame having an opening into a space in a ceiling of a room. Then there is the step of introducing a housing through the opening in the frame into the ceiling. Next there is the step of fitting a bottom edge of the housing about a ridge of the frame which extends inwards into the ceiling wherein the bottom edge is hidden by the frame. Then there is the step of setting at least one mechanism for holding a light in the housing.

BRIEF DESCRIPTION OF THE DRAWINGS

In the accompanying drawings, the preferred embodiment of the invention and preferred methods of practicing the invention are illustrated in which.

DETAILED DESCRIPTION

Figure 2:
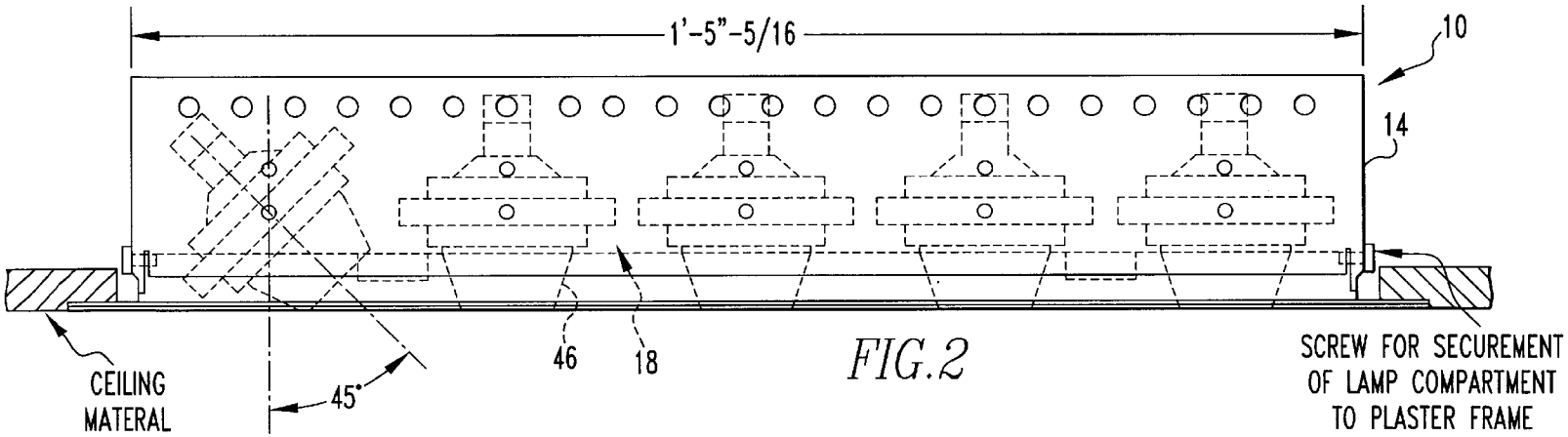
FIG. 2 is a side view of a lighting apparatus of the present invention.
Figure 1:
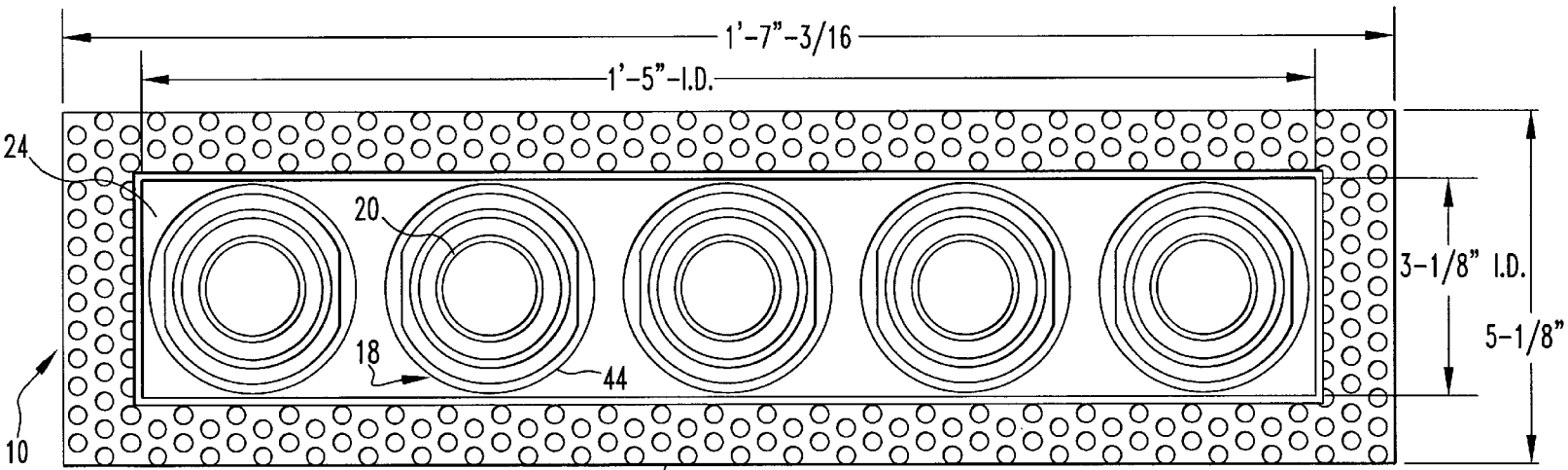
FIG. 1 is a bottom view of a lighting apparatus of the present invention.
Figure 3:
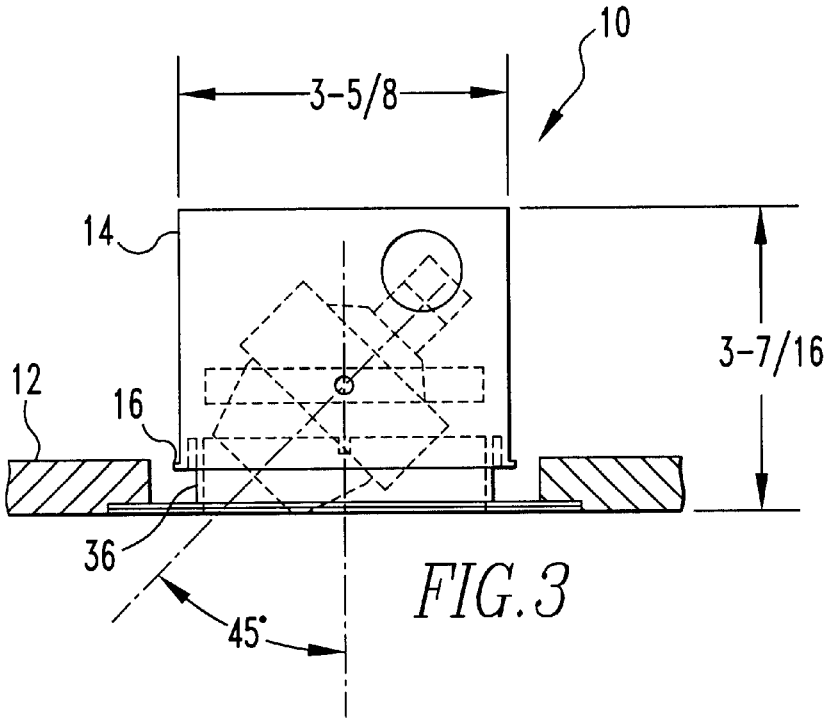
FIG. 3 is an end view of a lighting apparatus of the present invention.
Figure 4:
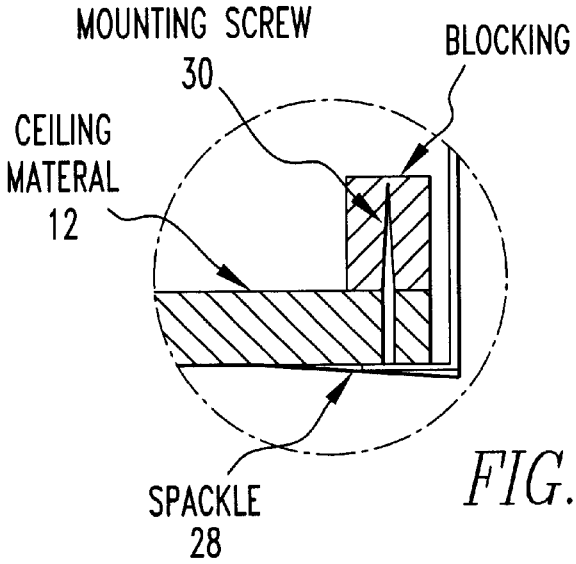
FIG. 4 is an expanded view of a screw holding the frame into the ceiling.

Referring now to the drawings wherein like reference numerals refer to similar or identical parts throughout the several views, and more specifically to FIGS. 1, 2, 3 and 4 thereof, there is shown an apparatus for lighting which fits into a wall, ceiling 12 or floor. The apparatus comprises a housing 14 having a bottom edge 16 and at least one mechanism for holding a light 20. The housing 14 has a depth. The apparatus comprises a frame 22 having an opening 24 having a width larger than the depth through which the housing 14 can fit. The housing 14 fits about the frame 22 wherein the bottom edge 16 is hidden by the frame 22.

Preferably, the frame 22 has a flange 26 on which spackle 28 is placed. The flange 26 is preferably perforated but need not be perforated. The apparatus preferably includes a screw 30 or bolt or rivet which extends through the frame 22 to hold the frame 22 to the wall, ceiling 12 or floor. A screw can also be used to secure the housing 14 to the ceiling, floor or wall. Preferably, the frame 22 has a ridge 36 which extends inwards. The bottom edge 16 of the housing 14 fits about the ridge 36. Alternatively, the housing can fit on the frame 22 by gravity in the ceiling 12.

Figure 16:
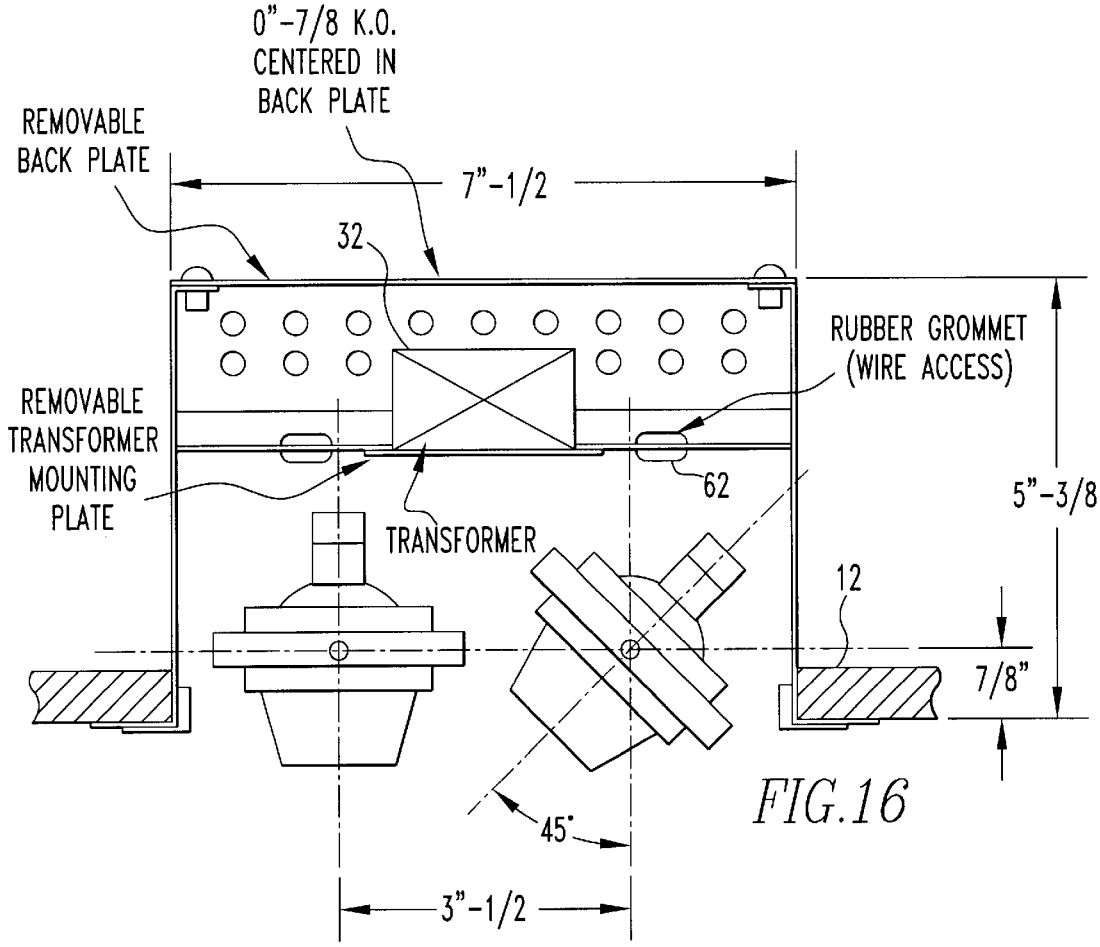
FIG. 16 is a side view of the lighting apparatus with a transformer inside the housing.

The apparatus preferably includes a transformer 32 connected to the light holding mechanism 18. Preferably, the transformer 32 is disposed on the top, above or side of the housing 14 and is accessible through the housing 14 when the transformer 32 and housing 14 are installed or removed in the floor, ceiling 12 or wall, as shown in FIG. 16. Alternatively, the transformer 32 is remote from the housing 14, and the apparatus includes wiring 34 connecting the transformer 32 to the light holding mechanism 18. The wiring 34 from the transformer 32 that is disposed outside of the housing 14 can be held in a flexible conduit 66, as shown in FIG. 7, which passes through a wire access 62 on the side of the housing 14.

Figure 18:
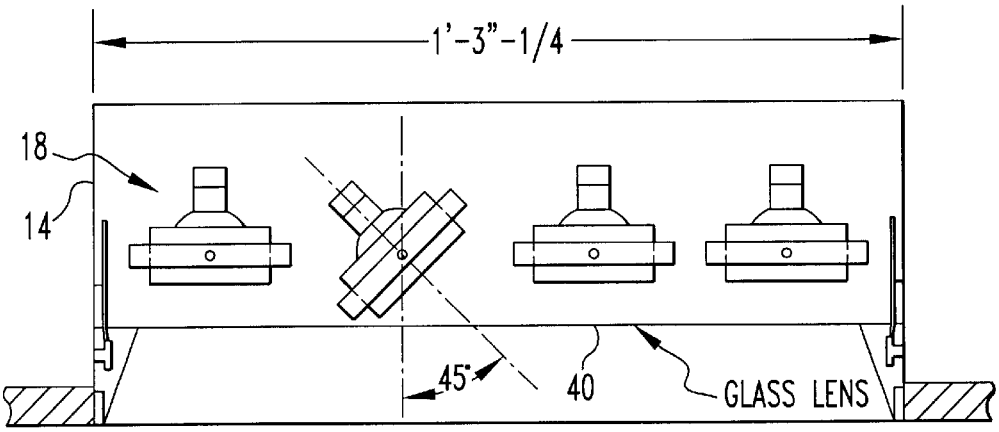
FIGS. 18 is a side view of a lighting apparatus with a lens.
Figure 17:
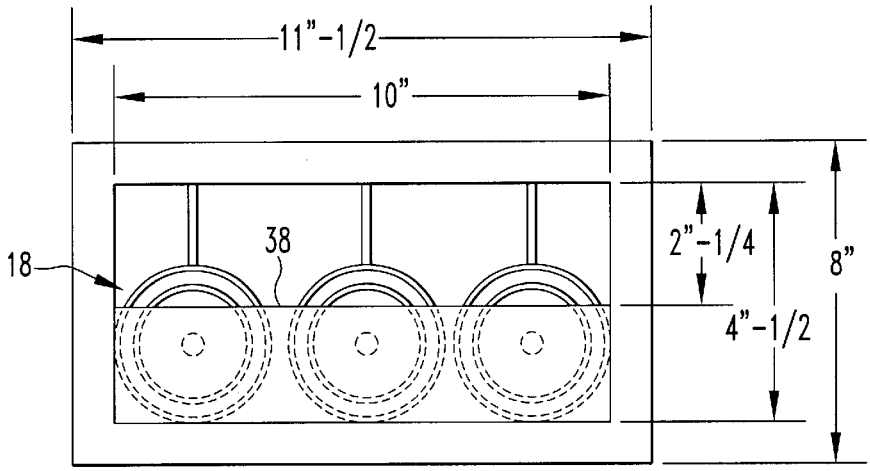
FIG. 17 is a bottom view of a lighting apparatus with a spill shield.
Figure 19:
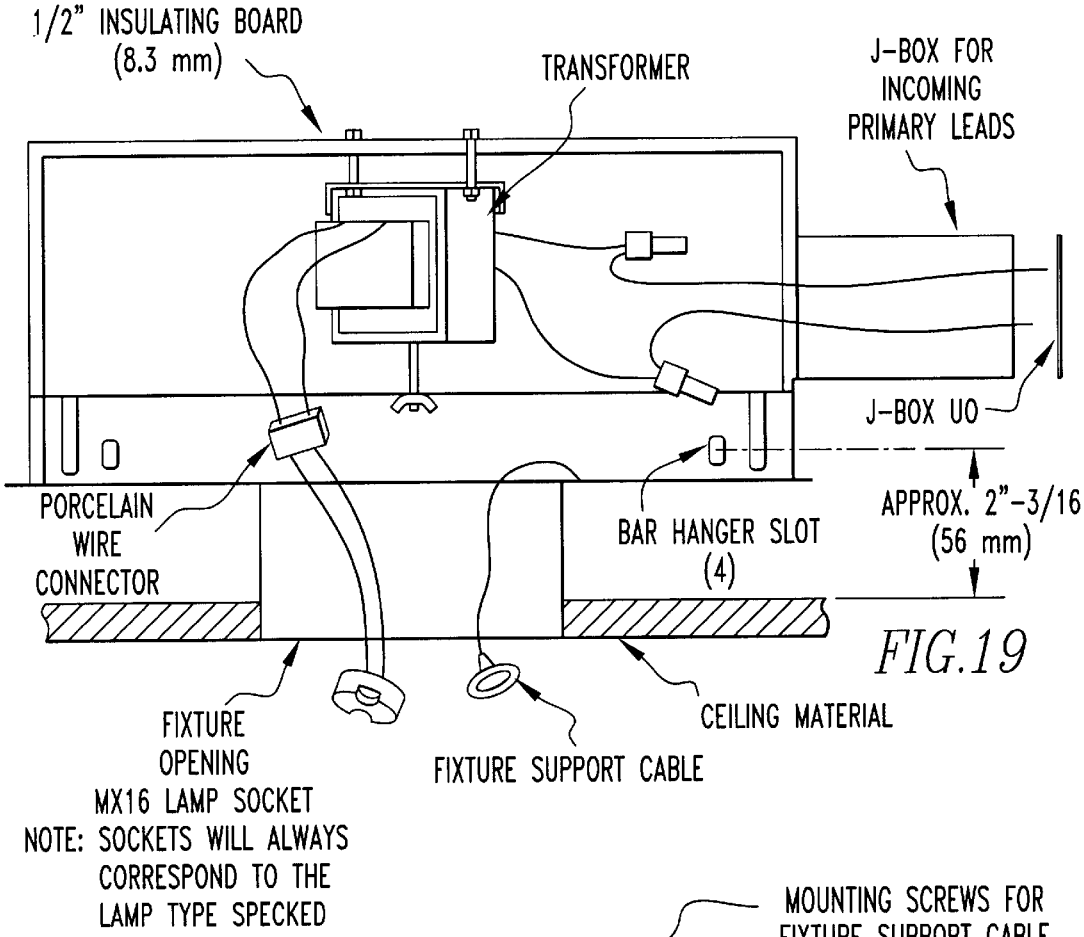
FIG. 19 is a side view of the lighting apparatus in regard to installation.
Figure 20:
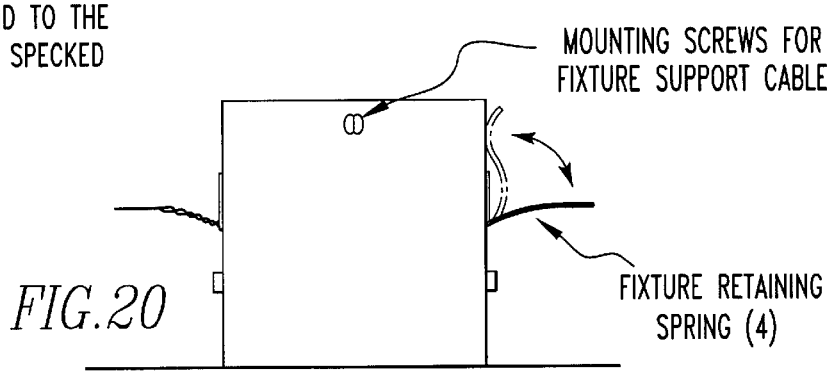
FIG. 20 is an end view of the lighting apparatus in regard to installation.
Figure 21:
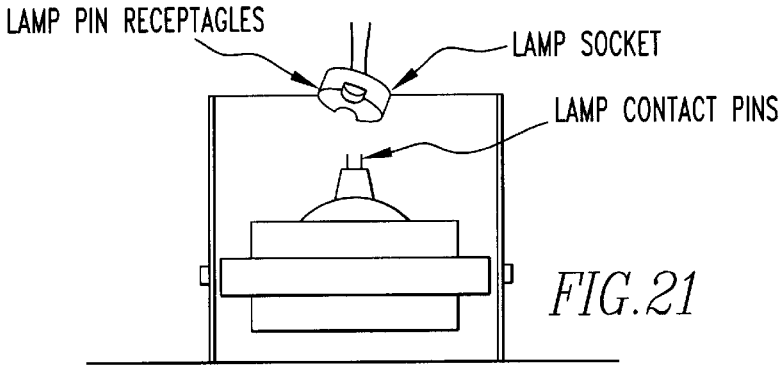
FIG. 21 is a view of the light in regard to installation.
Figure 22:
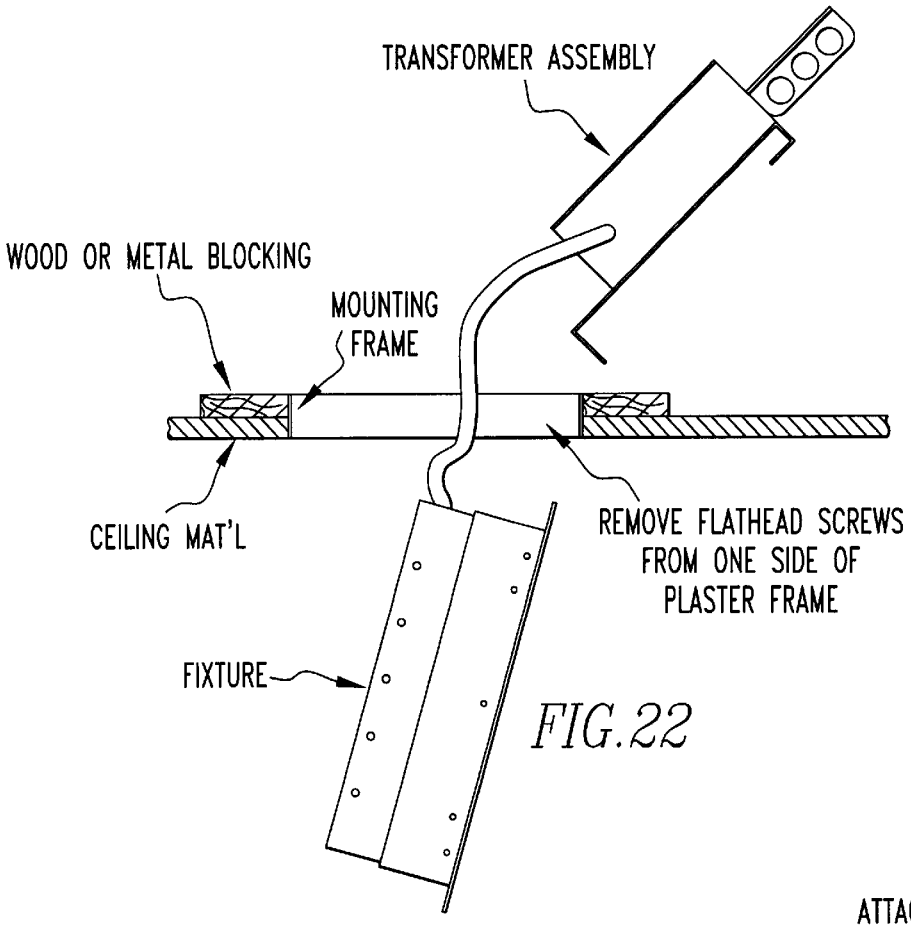
FIG. 22 is a side view of the lighting apparatus in regard to installation.
Figure 23:
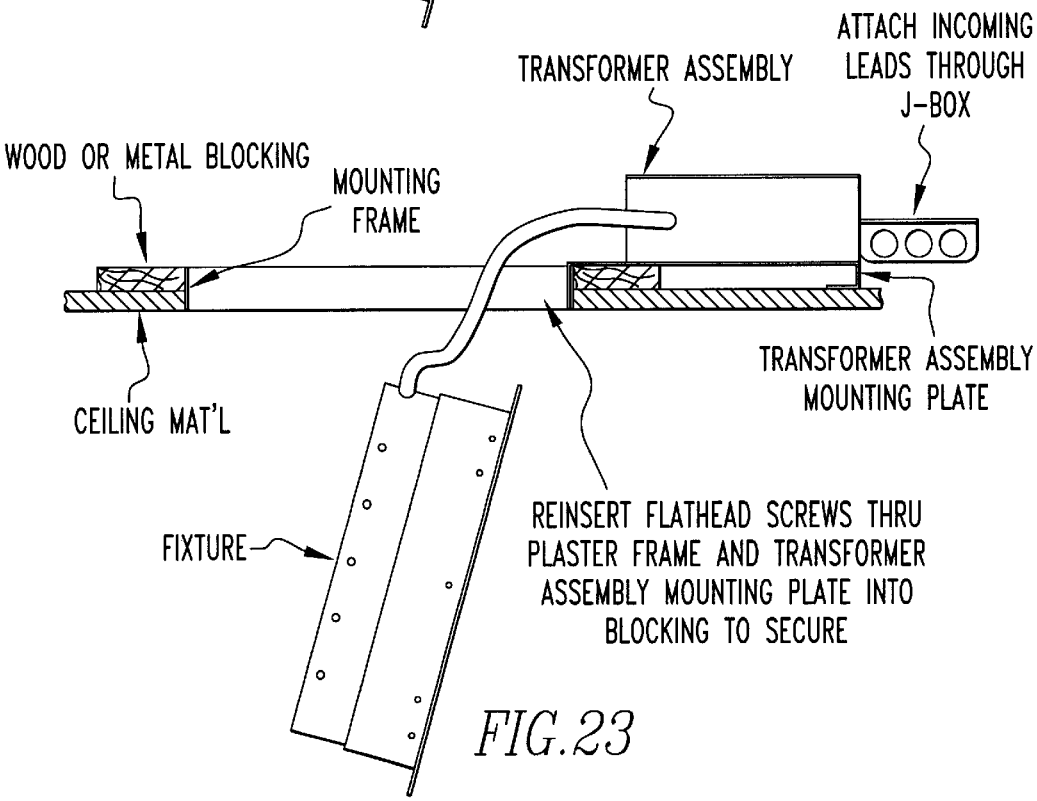
FIG. 23 is a side view of the lighting apparatus in regard to installation.

Preferably, the light holding mechanism 18 minds includes a gimbal ring assembly 44 or yoke. The light holding mechanism 18 can include a shielding cone 46. The housing 14 can include a spill shield 38, as shown in FIG. 17, or lens 40, as shown in FIG. 18, disposed below the light holding mechanism 18.

Figure 8A:
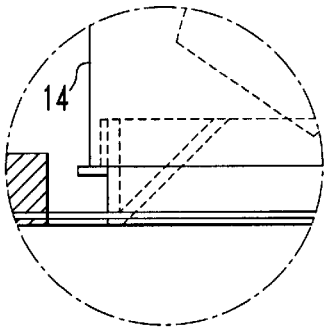
FIGS. 8*a* and 8*b* are expanded views of a baffle that is part of the frame.
Figure 8B:
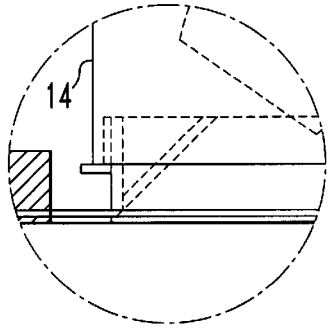
Figure 8C:
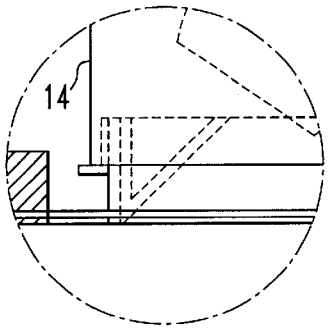
FIGS. 8*c* and 8*d* are expanded views of a baffle which is part of the housing.
Figure 8D:
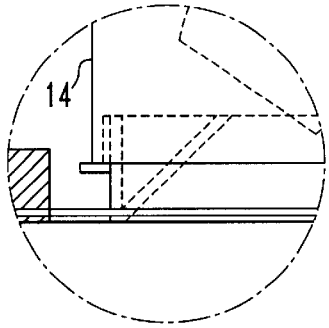
Figure 9:
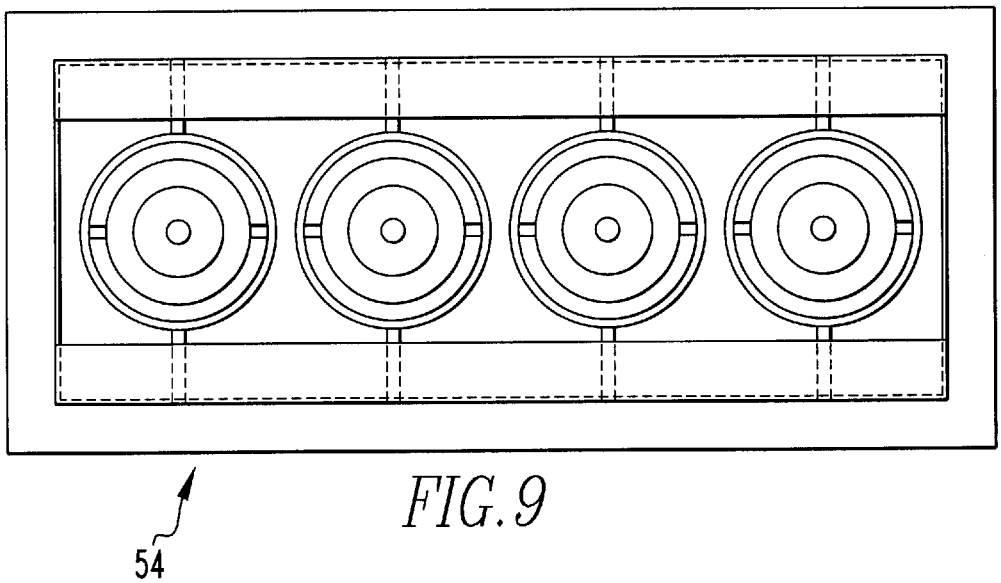
FIG. 9 is a bottom view of a two-sided symmetric baffle.
Figure 10:
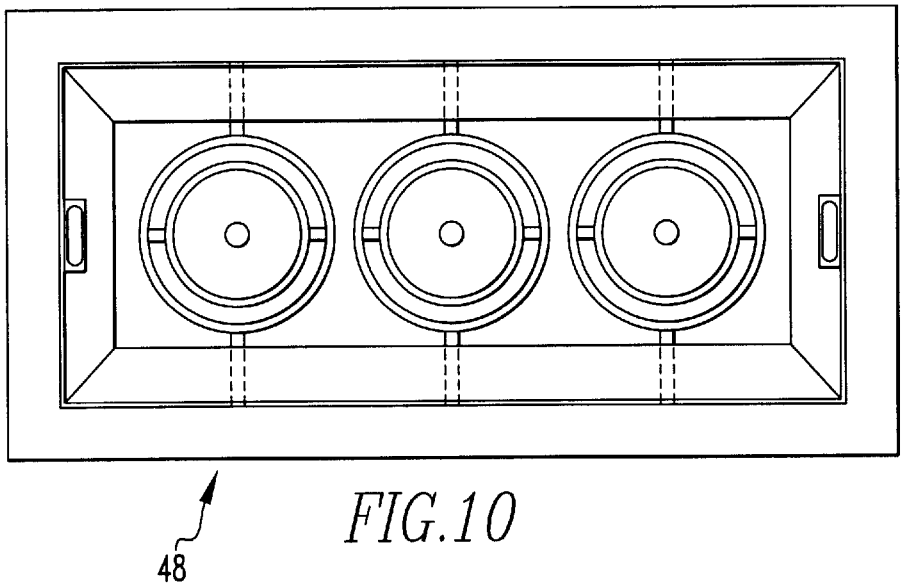
FIG. 10 is a bottom view of a four-sided symmetrical baffle.
Figure 11:
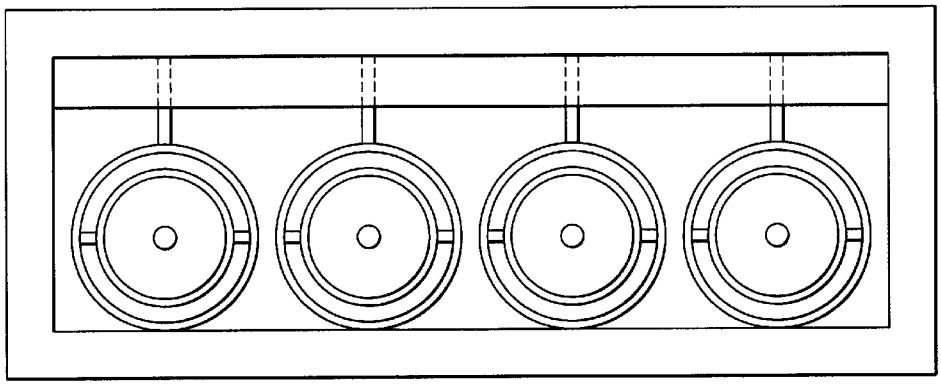
FIG. 11 is a bottom view of a one-sided asymmetric baffle.
Figure 12:
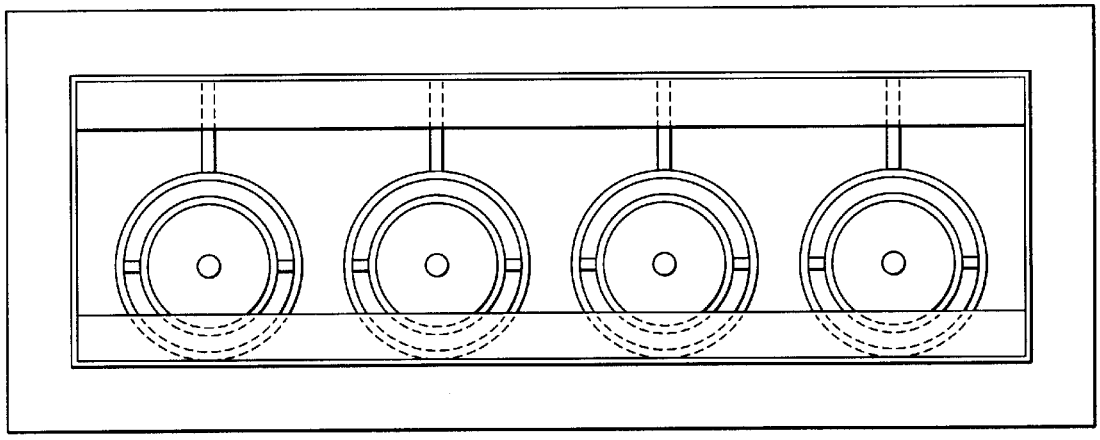
FIG. 12 is a bottom view of a two-sided asymmetrical baffle.
Figure 13:
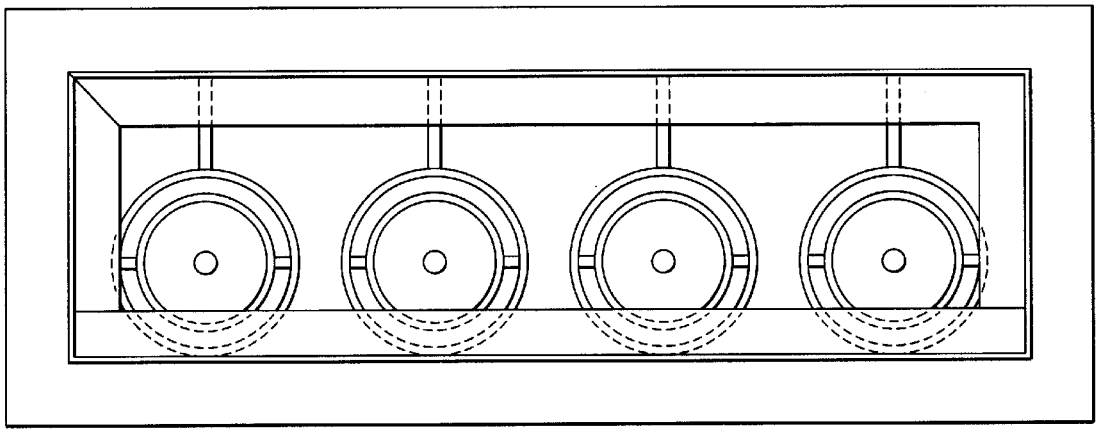
FIG. 13 is a bottom view of a two-sided asymmetrical baffle with symmetrical ends.
Figure 14:
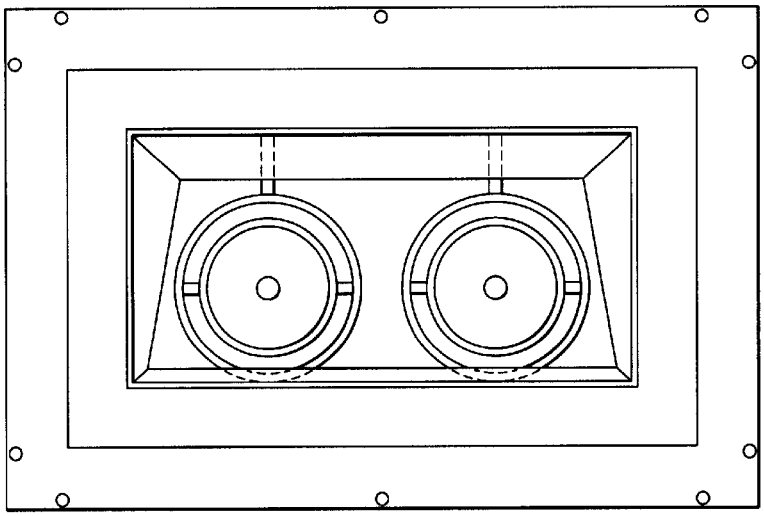
FIG. 14 is a bottom view of a truncated two-sided asymmetrical baffle with asymmetrical ends.
Figure 15:
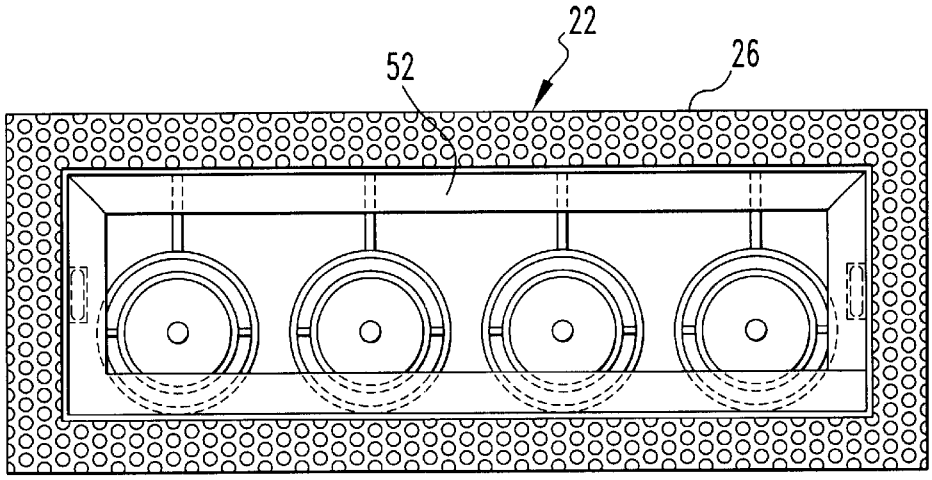
FIG. 15 is a bottom view of a four-sided removable asymmetric baffle.

The housing 14 can include either a four-sided removable symmetric baffle 48 shown in FIG. 10, a one-sided asymmetric baffle 50 shown in FIG. 11, a four-sided removable asymmetric baffle 52 shown in FIG. 15, a two-sided symmetric baffle 54 shown in FIG. 9, a two-sided asymmetric baffle 56 shown in FIG. 12, a two-sided asymmetric baffle with symmetrical ends 58 shown in FIG. 13, or a truncated two-sided asymmetric baffle with asymmetric ends 60 shown in FIG. 14. The baffle can be part of the housing 14, as shown in FIGS. 8*c* and 8*d*, or alternatively, the baffle can be part of the frame 22, as shown in FIGS. 8*a* and 8*b*.

Figure 6:
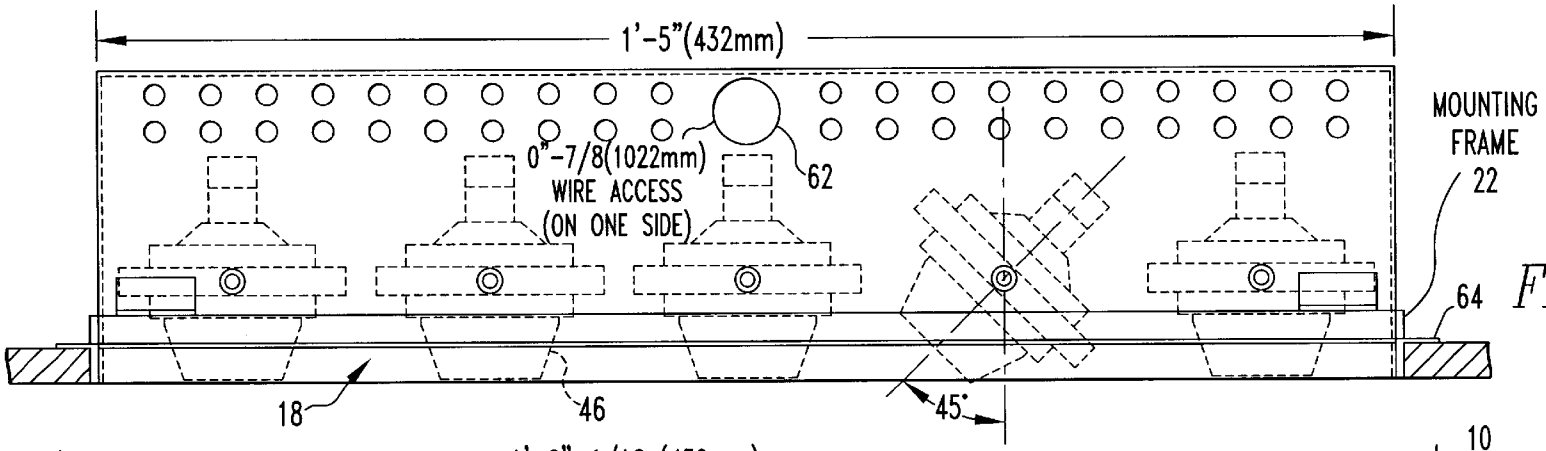
FIG. 6 is a side view of an alternative embodiment of a lighting apparatus of the present invention.
Figure 5:
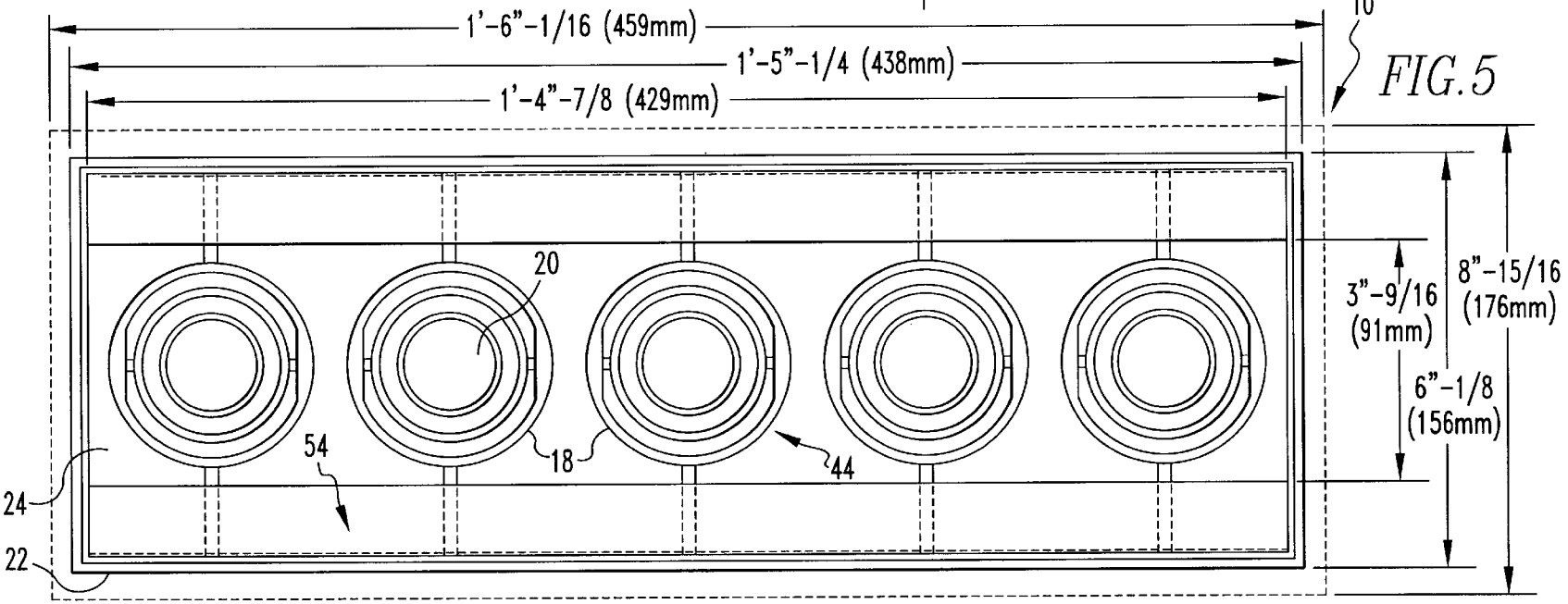
FIG. 5 is a bottom view of an alternative embodiment of a lighting apparatus of the present invention.
Figure 7:
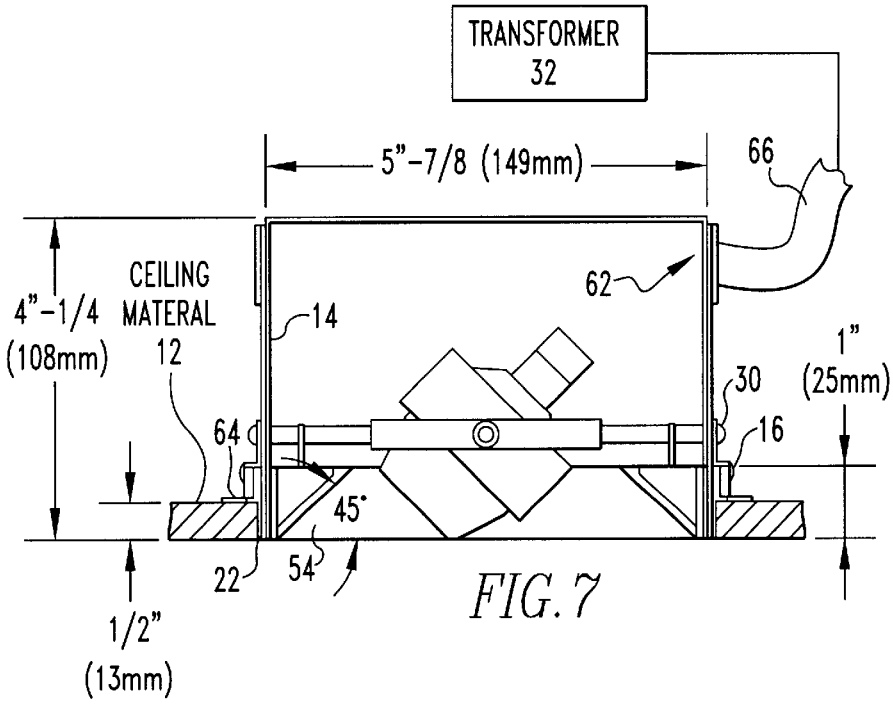
FIG. 7 is an end view of an alternative embodiment of a lighting apparatus of the present invention.

In an alternative embodiment, as shown in FIGS. 5, 6 and 7, the frame 22 can have the flange omitted. In this case, the frame 22 has a seat 64 which extends outward and rests on the inner or top surface of the ceiling 12 to hold the frame 22 to the ceiling. The housing 14 then fits on top of the frame 22 so the bottom edge 16 is not visible.

The present invention pertains to a method for installing an apparatus for lighting. The method comprises the steps of placing a frame 22 having an opening 24 into a space in a ceiling 12 of a room. Then there is the step of introducing a housing 14 through the opening 24 in the frame 22 into the ceiling 12. Next there is the step of fitting a bottom edge 16 of the housing 14 about a ridge 36 of the frame 22 which extends inwards into the ceiling 12 wherein the bottom edge 16 is hidden by the frame 22. Then there is the step of setting at least one mechanism for holding a light 20 in the housing 14.

Preferably, the placing step includes the step of spackling spackle 28 onto a flange 26 of the frame 22. After the setting step, there is preferably the step of positioning a baffle on the housing 14 below the light holding mechanism 18.

In the operation of the preferred embodiment, a wall, ceiling 12 or floor is prepared for receipt of a lighting apparatus 10. (For purposes of discussion, reference will only be made to a ceiling 12, but the following description is also applicable for a wall or floor.) Basically, this means that an opening is created in the ceiling 12 in which the lighting apparatus 10 will be located.

A frame 22 of the lighting apparatus 10 is placed into the opening 24 in the ceiling 12. The frame 22 has a perforated flange 26 which extends about its circumference that contacts the bottom of the ceiling 12 about the opening 24. The frame 22 is held in place with the flange 26 in contact against the ceiling 12, and mounting screws 30 are placed through respective perforations in the flange 26. The mounting screws 30 penetrate the ceiling 12 material and blocking to hold the frame 22 in place. Spackle 28 is placed over the perforated flange 26 to cover it from view by people in the room looking up at the lighting apparatus 10 in the ceiling 12.

The housing 14 of the lighting apparatus 10 is then inserted through the opening 24 in the frame 22 so the housing 14 is inside the ceiling 12. The depth of the housing 14 is less than the width of the opening 24 of the frame 22 so the housing 14 can fit through the opening 24. It may be that the housing 14 has to be rotated or turned so that portion of the housing 14 whose depth is less than the width of the opening 24 is exposed to the opening 24 to fit through the opening 24, but the housing 14 can then be realigned after it passes through the opening 24 of the frame 22 to be properly positioned on the frame 22. Furthermore, it could be that the housing 14 is made of two or more parts to allow it to fit through the opening 24 of the frame 22. In this instance, the different parts of the housing 14 will then be reassembled after they have fit through the opening 24 and are in the ceiling 12. Once the housing 14 is inserted into the ceiling 12 through the opening 24 of the frame 22, it is aligned so its bottom edge 16 is positioned about a ridge 36 of the frame 22 which extends in words from the frame 22 into the ceiling 12. The housing 14 is lowered down onto the top surface (the non-exposed portion) of the ceiling 12 so the ridge 36 of the frame 22 is now inside of the housing 14 bottom edge 16 circumference. The housing 14 can be either snapped into place on the ridge 36 that snaps on the ridge 36, or can be screwed or riveted into place to the ridge 36 to be held securely in the ceiling 12. It is preferable that the housing 14 is snapped or screwed into the ridge 36 so that the housing 14 at some later time, if desired, can be removed from the ceiling 12 through the opening 24 in the frame 22 in the opposite way that the housing 14 was put in the ceiling 12. With the ridge 36 disposed inside the circumference of the bottom edge 16 of the housing 14, the frame 22 hides the bottom edge 16 of the housing 14 from view and eliminates the line or edge or space created between a frame 22 in the housing 14 if the housing 14 was positioned inside of the ridge 36 of the frame 22.

A light holding mechanism 18 can then be installed into the housing 14. Typically, there can be unlimited, and preferably from 1 to 30 light holding mechanisms 18. Alternatively, the light holding mechanisms 18 can already be installed in the housing 14 before it is inserted into the opening 24 in the frame 22, if it is so desired, and if the presence of the light holding mechanism 18 does not extend the effective depth of the housing 14 to such a degree that the housing 14 with the light holding mechanism 18 can no longer fit through the opening 24 in the frame 22. The light holding mechanism 18 can be for instance a gimbal ring assembly 44.

The various gimbal ring assemblies, or yokes, can be positioned properly with the lights 20 installed in the gimbal ring assemblies or yokes. Of course, if the gimbal ring assemblies or yokes effectively do extend the effective depth of the housing 14, then they must be removed or at least portions of them removed so that the effective depth of the housing 14 is again less than the width of the opening 24 of the frame 22 so the housing 14 can be removed from the ceiling 12 through the opening 24 in the frame 22.

The housing 14 can have in it a transformer 32 for the lights 20 in the gimbal ring assemblies and can be held by a removable transformer 32 mounting plate in the housing 14. Alternatively, the transformer 32 can be positioned aside the housing 14 for the lighting in the gimbal ring assemblies and is connected to them through wires. Alternatively, the transformer 32 can be remote from the housing 14 and connected to the lights 20 in the gimbal ring assemblies through wires running along the ceiling 12. Also, spill shield 38 or lenses 40 can be positioned in the housing 14 below the gimbal ring assemblies, either individually or collectively with respect to each gimbal ring assembly 44 and the housing 14. Shielding cones 46 can also be positioned on the gimbal ring assemblies, if desired. Alternatively, a flat plate with a hole for every light can be used so the housing itself is not seen. Furthermore, the housing 14 can also include different types of baffles to further accent the lighting and the aesthetic value of any housing 14.

With reference to FIGS. 19, 20, 21, 22 and 23, the lighting apparatus 10 is installed in the following manner.

HOUSING:

1. Slide Bar Hangers Through Openings Provided.
2. Mount Bar Hangers to Existing Structure So That Frame Opening Will Be Flush With Finished Ceiling.
3. Attach Incoming Primary Leads In J-Box Located On Site of the Housing.

FRAME:

4. Turn Off Power to Housing.
5. Connect Fixture Support Cable to Fixture Trim With 8-32 Screw.
6. Connect Lamp Sockets to Lamps in Fixture Trim.
7. Compress the Four (4) Fixture Retaining Springs Away From the Face of Fixture and Insert Fixture Trim Into Opening of Housing.
8. Turn Power on to Housing.

Although the invention has been described in detail in the foregoing embodiments for the purpose of illustration, it is to be understood that such detail is solely for that purpose and that variations can be made therein by those, skilled in the art without departing from the spirit and scope of the invention except as it may be described by the following claims.

What is claimed is:

1. An apparatus for lighting which fits into a ceiling comprising:

a housing having a top with four sides extending from the top, the four sides forming a bottom edge that define an open area, the housing having at least one mechanism for holding a light, said housing having a depth; and a frame having an opening having a width larger than the depth through which the housing can fit, the housing fitting about the frame wherein the bottom edge is hidden by the frame, said frame distinct from said housing, said frame adapted to be attached to the ceiling, the frame having a flange about which spackle is placed.

2. An apparatus as described in claim 1 wherein the flange is perforated.

3. An apparatus as described in claim 1 including a screw or bolt or rivet which extends through the frame to hold the frame to the ceiling.

4. An apparatus as described in claim 1 including a transformer connected to the light holding mechanism.

5. An apparatus as described in claim 4 wherein the transformer is disposed on the top of the housing and is accessible through the housing when the transformer and housing are installed in the ceiling.

6. An apparatus as described in claim 4 wherein the transformer is remote from the housing, and includes wiring connecting the transformer to the light holding mechanism.

7. An apparatus as described in claim 1 wherein the frame has a ridge which extends inwards the bottom edge of the housing fitting about the ridge.

8. An apparatus as described in claim 1 wherein the housing includes a spill shield disposed below the light holding mechanism.

9. An apparatus as described in claim 1 wherein the light holding mechanism includes a shielding cone.

10. An apparatus as described in claim 1 wherein the housing includes a one-sided asymmetric baffle.

11. An apparatus as described in claim 1 wherein the housing includes a two-sided symmetric baffle.

12. An apparatus as described in claim 1 wherein the housing includes a two-sided asymmetric baffle.

13. An apparatus as described in claim 1 wherein the housing includes a two-sided asymmetric baffle with symmetrical ends.

14. An apparatus as described in claim 1 wherein the housing includes a truncated two-sided asymmetric baffle with asymmetric ends.

15. An apparatus as described in claim 1 wherein the housing includes a lens disposed below the light holding mechanism.

16. A method for installing an apparatus for lighting comprising the steps of:

placing a frame having an opening into a space in a ceiling of a room;

spackling spackle onto a flange of the frame;

introducing a rectangular-shaped housing having an open area through the opening in the frame into the ceiling;

fitting a bottom edge of the housing, which defines the open area, about a ridge of the frame which extends inwards into the ceiling wherein the bottom edge is hidden by the frame; and setting at least one mechanism for holding a light in the housing.

17. A method as described in claim 16 including after the setting step, there is the step of positioning a baffle on the housing below the light holding mechanism.

18. A method as described in claim 16 wherein the setting step includes the step of setting a gimbal ring assembly in the housing.

19. A method as described in claim 18 wherein the step of setting the gimbal ring assembly includes the step of rotating the gimbal ring assembly to a desired position.

20. A method as described in claim 16 including the step of positioning a lens across the open area.

21. An apparatus for lighting which fits into a ceiling comprising:

housing having a bottom edge and at least one mechanism for holding a light, said housing having a depth and a four-sided removable symmetric baffle; and a frame having an opening having a width larger than the depth through which the housing can fit, the housing fitting about the frame wherein the bottom edge is hidden by the frame.

22. An apparatus as described in claim 21 wherein the frame has a flange about which spackle is placed.

23. An apparatus as described in claim 22 wherein the flange is perforated.

24. An apparatus as described in claim 21 including a screw or bolt or rivet which extends through the frame to hold the frame to the ceiling.

25. An apparatus as described in claim 24 including a transformer connected to the light holding mechanism.

26. An apparatus as described in claim 25 wherein the transformer is disposed on the top of the housing and is accessible through the housing when the transformer and housing are installed in the ceiling.

27. An apparatus as described in claim 25 wherein the transformer is remote from the housing, and includes wiring connecting the transformer to the light holding mechanism.

28. An apparatus as described in claim 21 wherein the frame has a ridge which extends inwards the bottom edge of the housing fitting about the ridge.

29. An apparatus as described in claim 21 wherein the housing includes a spill shield disposed below the light holding mechanism.

30. An apparatus as described in claim 21 wherein the light holding mechanism includes a shielding cone.

31. An apparatus as described in claim 21 wherein the housing includes a lens disposed below the light holding mechanism.

32. An apparatus for lighting which fits into a ceiling comprising:

a housing having a bottom edge and at least one mechanism for holding a light, said housing having a depth and a four-sided removable asymmetric baffle; and a frame having an opening having a width larger than the depth through which the housing can fit, the housing fitting about the frame wherein the bottom edge is hidden by the frame.

33. An apparatus as described in claim 32 wherein the frame has a flange about which spackle is placed.

34. An apparatus as described in claim 33 wherein the flange is perforated.

35. An apparatus as described in claim 32 including a screw or bolt or rivet which extends through the frame to hold the frame to the ceiling.

36. An apparatus as described in claim 35 including a transformer connected to the light holding mechanism.

37. An apparatus as described in claim 36 wherein the transformer is disposed on the top of the housing and is accessible through the housing when the transformer and housing are installed in the ceiling.

38. An apparatus as described in claim 36 wherein the transformer is remote from the housing, and includes wiring connecting the transformer to the light holding mechanism.

39. An apparatus as described in claim 32 wherein the frame has a ridge which extends inwards the bottom edge of the housing fitting about the ridge.

40. An apparatus as described in claim 32 wherein the housing includes a spill shield disposed below the light holding mechanism.

41. An apparatus as described in claim 32 wherein the light holding mechanism includes a shielding cone.

42. An apparatus for lighting which fits into a ceiling comprising:

a housing having a top with four sides extending from the top, the four sides forming a bottom edge that define an open area, the housing having at least one mechanism for holding a light, the light holding mechanism includes a gimbal ring assembly, said housing having a depth; and a frame having an opening having a width larger than the depth through which the housing can fit, the housing fitting about the frame wherein the bottom edge is hidden by the frame, said frame distinct from said housing, said frame adapted to be attached to the ceiling.

43. An apparatus as described in claim 42 wherein the frame has a flange about which spackle is placed.

44. An apparatus as described in claim 43 wherein the flange is perforated.

45. An apparatus as described in claim 42 including a screw or bolt or rivet which extends through the frame to hold the frame to the ceiling.

46. An apparatus as described in claim 45 including a transformer connected to the light holding mechanism.

47. An apparatus as described in claim 46 wherein the transformer is disposed on the top of the housing and is accessible through the housing when the transformer and housing are installed in the ceiling.

48. An apparatus as described in claim 46 wherein the transformer is remote from the housing, and includes wiring connecting the transformer to the light holding mechanism.

49. An apparatus as described in claim 42 wherein the frame has a ridge which extends inwards the bottom edge of the housing fitting about the ridge.

50. An apparatus as described in claim 42 wherein the housing includes a spill shield disposed below the light holding mechanism.

51. An apparatus as described in claim 42 wherein the light holding mechanism includes a shielding cone.

52. An apparatus as described in claim 42 wherein the housing includes a four-sided removable symmetric baffle.

53. An apparatus as described in claim 42 wherein the housing includes a one-sided asymmetric baffle.

54. An apparatus as described in claim 42 wherein the housing includes a four-sided removable asymmetric baffle.

55. An apparatus as described in claim 42 wherein the housing includes a two-sided symmetric baffle.

56. An apparatus as described in claim 42 wherein the housing includes a two-sided asymmetric baffle.

57. An apparatus as described in claim 42 wherein the housing includes a two-sided asymmetric baffle with symmetrical ends.

58. An apparatus as described in claim 42 wherein the housing includes a truncated two-sided asymmetric baffle with asymmetric ends.

59. An apparatus as described in claim 42 wherein the housing includes a lens disposed below the light holding mechanism.

60. A method for installing an apparatus for lighting comprising the steps of:

placing a frame having an opening into a space in a ceiling of a room;

introducing a rectangular-shaped housing having an open area through the opening in the frame into the ceiling;

fitting a bottom edge of the housing, which defines the open area, about a ridge of the frame which extends inwards into the ceiling wherein the bottom edge is hidden by the frame; and setting at least one gimbal ring assembly for holding a light in the housing.

61. A method as described in claim 60 wherein the step of setting the gimbal ring assembly includes the step of rotating the gimbal ring assembly to a desired position.

62. A method as described in claim 60 including the step of positioning a lens across the open area.

* * * * *